US012075960B2

(12) United States Patent
Ko

(10) Patent No.: US 12,075,960 B2
(45) Date of Patent: Sep. 3, 2024

(54) DISHWASHER INCLUDING A STORAGE PART

(71) Applicant: LG Electronics Inc., Seoul (KR)

(72) Inventor: Myungwon Ko, Seoul (KR)

(73) Assignee: LG Electronics Inc., Seoul (KR)

( * ) Notice: Subject to any disclaimer, the term of this patent is extended or adjusted under 35 U.S.C. 154(b) by 6 days.

(21) Appl. No.: 17/980,734

(22) Filed: Nov. 4, 2022

(65) Prior Publication Data

US 2023/0148039 A1 May 11, 2023

(30) Foreign Application Priority Data

Nov. 9, 2021 (KR) ..... 10-2021-0153350

(51) Int. Cl.
*A47L 15/50* (2006.01)
*A47L 15/14* (2006.01)

(52) U.S. Cl.
CPC ..... *A47L 15/50* (2013.01); *A47L 15/14* (2013.01); *A47L 15/504* (2013.01)

(58) Field of Classification Search
CPC ..... A47L 15/14; A47L 15/50; A47L 15/504; A47L 15/506; A47L 15/507; A47L 15/28; A47L 15/34
USPC ..... 211/41.8
See application file for complete search history.

(56) References Cited

U.S. PATENT DOCUMENTS 3,472,573 A * 10/1969 Geiger ..... A47L 15/504 312/351
3,560,069 A * 2/1971 Doepke ..... A47L 15/504 312/351
3,726,580 A * 4/1973 Guth ..... A47B 88/407 312/351
3,822,085 A * 7/1974 Clark ..... A47B 88/407 312/351
5,595,200 A * 1/1997 Favaro ..... A47L 15/504 134/201
6,974,040 B2 * 12/2005 Jahrling ..... A47L 15/504 211/175
7,410,228 B2 * 8/2008 Dickson ..... A47L 15/504 312/351
7,418,967 B2 * 9/2008 Kim ..... A47L 15/504 312/351

(Continued)

FOREIGN PATENT DOCUMENTS

EP 2820998 A1 1/2015
EP 3175763 A1 6/2017

(Continued)

OTHER PUBLICATIONS

European Search Report in European Appln. No. 22204609.6, mailed on Mar. 17, 2023, 10 pages.

*Primary Examiner* — Jennifer E. Novosad
(74) *Attorney, Agent, or Firm* — Fish & Richardson P.C.

(57) ABSTRACT

A dishwasher includes a storage part in which a washing target is stored. The storage part includes a guide disposed in an edge area, a frame coupled to the guide, and a tray coupled to the frame. The tray includes a locking portion protruding from an edge area thereof and coupled to the frame, and configured to elevate the tray with respect to the frame. The frame includes a slot in which the locking portion is inserted, and a rail protruding toward the slot and forming some area of an outer shape of the slot, and configured to guide the movement of the locking portion and suppress the locking portion from being separated from the slot.

20 Claims, 17 Drawing Sheets

(56) References Cited

U.S. PATENT DOCUMENTS

| | | | | |
|---|---|---|---|---|
| 7,644,826 | B2 * | 1/2010 | Koch | A47L 15/503 211/41.4 |
| 8,191,560 | B2 * | 6/2012 | Mallory | A47L 15/503 134/145 |
| 8,534,471 | B2 * | 9/2013 | Wong | A47L 15/504 312/351 |
| 9,420,882 | B2 * | 8/2016 | Garcia | A47B 46/005 |
| 9,516,990 | B2 * | 12/2016 | Graute | A47L 15/504 |
| 10,052,011 | B2 * | 8/2018 | Shin | A47L 15/504 |
| 10,383,506 | B2 * | 8/2019 | Minniti | A47L 15/504 |
| 10,743,742 | B2 * | 8/2020 | Buesing | A47L 15/506 |
| 10,779,705 | B2 * | 9/2020 | Ko | A47L 15/502 |
| 11,406,244 | B2 * | 8/2022 | Ko | A47L 15/4278 |
| 11,445,887 | B2 * | 9/2022 | Singhal | A47L 15/507 |
| 11,751,750 | B2 * | 9/2023 | Kim | A47L 15/504 211/41.8 |
| 11,759,088 | B2 * | 9/2023 | Tütek | A47L 15/504 211/41.8 |
| 2007/0039904 | A1 * | 2/2007 | Purushothaman | A47L 15/504 211/41.8 |
| 2008/0011337 | A1 * | 1/2008 | Ryu | A47L 15/504 134/147 |
| 2008/0272072 | A1 * | 11/2008 | Tynes | A47L 15/504 312/228.1 |
| 2018/0206700 | A1 * | 7/2018 | Ko | A47L 15/506 |
| 2023/0148039 | A1 * | 5/2023 | Ko | A47L 15/14 211/41.8 |

FOREIGN PATENT DOCUMENTS

| | | | | |
|---|---|---|---|---|
| EP | 3593697 | A1 | 1/2020 | |
| EP | 3337375 | | 4/2020 | |
| EP | 3766402 | A1 | 1/2021 | |
| EP | 4176793 | A1 * | 5/2023 | A47L 15/14 |

* cited by examiner

DISHWASHER INCLUDING A STORAGE PART

CROSS-REFERENCE TO RELATED APPLICATION

This application claims priority to and benefit of Korean Patent Application No. 10-2021-0153350, filed on Nov. 9, 2021, which is hereby incorporated by reference as if fully set forth herein.

BACKGROUND

Technical Field

The present disclosure relates to a dishwasher, more particularly, a dishwasher including a storage part.

Background of the Disclosure

Description disclosed in the background only provides background information on the present disclosure and may not constitute the prior art.

In general, a dishwasher is an electric appliance that washes and dries stored dishes by spraying wash water at a high pressure to the stored dishes. Specifically, in such a dishwasher, wash water is sprayed into a tub, in which dishes are stored, at a high pressure and the sprayed wash water comes into contact with the dishes to wash off contaminations such as food scraps remaining on surfaces of the dishes.

The dishwasher may recycle the used wash water by filtering food residues contained in the wash water through a filter, and it may smoothly separate food residues from the wash water by dissolving and supplying a washing detergent to the wash water. Also, in recent, there has been widely used a dishwasher that increasing the temperature of the wash water by using a heater or generating steam to increase washing efficiency.

The dishwasher includes a tub as a washing space and a storage part releasably provided with respect to the washing tub and configured to selectively accommodate dishes depending on types and sizes.

In this instance, the storage part may be provided in plural and each storage part may be disposed along a vertical direction of the washing tub in multiple steps. In the storage part may be provided a tray having a structure configured to elevate for a user's convenience.

Related art is disclosed in U.S. Ser. No. 10/779,704 B2 and EP3337375B1.

Since a tray having a structure configured to elevate is provided for a user's convenience, the structure of the tray needs to be easily operated by the user.

In addition, since such a tray elevates continuously and repeatedly, the structure of the tray needs to be configured to suppress occurrence of malfunction due to bending by the load applied to the tray.

For the user to use the tray conveniently, the tray needs to have a structure that may be easily assembled or dissembled.

SUMMARY

One objective of the present disclosure is to provide a dishwasher including a tray having a structure used by a user easily.

A further object of the present disclosure is to provide a dishwasher including a tray configured to suppress occurrence of malfunction due to bending by the load applied to the tray.

A still further object of the present disclosure is to provide a dishwasher including a tray having a structure that facilitates easy assembling and dissembling.

Aspects according to the present disclosure are not limited to the above ones, and other aspects and advantages that are not mentioned above can be clearly understood from the following description and can be more clearly understood from the embodiments set forth herein.

A storage part according to an embodiment may include a guide, a frame and a tray. The guide may be disposed in an edge area. The frame may be coupled to the guide and a securing space in which the frame is secured may be formed in the guide. The frame may be movably secured to the guide in a horizontal direction. The frame may be coupled to the frame and configured to elevate along with the horizontal movement of the frame.

The storage part may include a first region, a second region and a partition bar. The tray may be disposed in the first region and be elevated by a user's manipulation. The second region may be partitioned off from the first region. The partition bar may be configured to partition off the first region and the second region.

The storage part further include a link configured to support horizontal movement and vertical movement of the tray, and having one end rotatably coupled to the guide and the other end rotatably coupled to the partition bar.

The link may include a first link, a second link and a third link. The first link may be provided in a pair and rotatably coupled to the guide and the partition bar, respectively. The second link may be provided in a pair and bent from the pair of first links, respectively. The third link may have both ends coupled to ends of the pair of second links and may be configured to support the tray by being coupled to the tray to cross the tray.

The storage part may further include a button secured to the frame and configured to be manipulated by a user to move the frame in a horizontal direction with respect to the guide. The button may be secured to the frame through a moving hole formed in the guide. The button may be configured to reciprocate in the moving hole in a horizontal direction with respect to the guide.

The tray may include a supporter portion and a holder portion. The holder portion may be secured to the supporter portion. The holder portion secured to the support portion may be rotatable with respect to the supporter portion.

The tray may include a locking portion protruding from an edge area thereof and coupled to the frame, and configured to elevate the tray by moving in an inclined direction with respect to the frame.

The frame may include a slot and a rail. The locking portion may be inserted in the slot. The rail may protrude toward the slot and form some area of an outer shape of the slot, and may be configured to guide the movement of the locking portion and to suppress the locking portion from being separated from the slot.

The locking portion may include a protrusion and a hook. The protrusion may protrude from an edge area of the tray and configured to be inserted in the slot. The hook may be bent from the protrusion and have on side that faces the rail.

The slot may include an inserting portion, an inclined portion and an upper end. The inserting portion may have some area formed in a shape corresponding to the hook. The hook may be inserted in the inserting portion. The inclined portion may be connected to the inserting portion and inclined with respect to a horizontal direction of the frame. The upper end may be connected to the inclined portion and defining a top of the slot.

The rail may be formed in a shape corresponding to the entire shape including the inserting portion, the inclined portion and the upper end of the slot. The rail may include a hook locking portion, a first bent portion and a second bent portion.

The hook locking portion may have an upper end defining a bottom end of the slot and configured to lock downward the hook inserted in the inserting portion. The first bent portion may be bent from the hook locking portion and having one side defining some area of the inclined portion of the slot. The second bent portion may be bent from the first bent portion and configured to support the hook when the hook is placed on a top end of the slot.

In an embodiment, the tray and the frame may be coupled to each other by inserting the hook in the inserting portion and locking the inserted hook to the rail. Meanwhile, the tray and the frame may be decoupled from each other by separating the hook from the inserting portion.

The guide may include a securing space and a moving hole. The securing space may be formed inside the guide and configured to provide a space in which the frame is secured and horizontally moves.

The moving hole may be connected to the securing space, and configured to provide a space in which the button is disposed and move in a horizontal direction. Some area of the button may be inserted in the moving hole to be coupled to the frame disposed in the securing space.

The moving hole may be formed in a length preset to limit a horizontal movement distance of the button. A horizontal movement range of the hook may be limited based on a horizontal movement range of the button.

The hook may have a horizontal movement range in which the hook does not reach the inserting portion of the slot, in a state where the frame is secured to the guide and the button is secured to the frame.

The button may include a manipulation protrusion, a first fitted portion and a second fitted portion. The manipulation protrusion may protrude upward from a center area of the button. The first fitted portion may have some area fitted to the frame in a longitudinal direction of the frame. The second fitted portion may have some area fitted to the frame in a direction crossing the longitudinal direction of the frame.

The first fitted portion may include a first projection and a first frame fitted portion. The first projection may protrude downward with respect to the button. The first frame fitted portion may be bent from the first projection in the longitudinal direction of the frame and configured to be fitted to the frame.

The second fitted portion may include a second projection and a second frame fitted portion. The second projection may be spaced apart from the first projection and protruding downward with respect to the button. The second frame fitted portion may be bent from the second projection in a direction crossing the longitudinal direction of the frame and configured to be fitted to the frame.

The frame may include a first groove, a second groove and a third groove. The first groove may be formed by recessing an upper area of the frame. In the first groove, the first projection and the second projection may be disposed.

The second groove may be connected to the first groove and recessed in the longitudinal direction of the frame. In the second groove, the first frame fitted portion may be fitted. The third groove may be connected to the first groove and recessed in a direction crossing the longitudinal direction of the frame. In the third groove, the second frame fitted portion may be fitted.

The tray may include a securing hole and a rotation limiting portion. The securing hole may be formed in a lower area of the tray. In the securing hole, the third hole is secured. The rotation limiting portion may have a lower surface configured to limit a rotation range of the second link by getting in contact with the second link.

The guide may include a securing space, a first seating portion and a second seating portion. The securing space may be a space formed in the guide. The frame may be horizontally movable in the securing space.

The first seating portion may be disposed in the securing space and protrude from an inner surface of the guide. The frame may be seated on the first seating portion and a longitudinal direction of the first seating portion may be parallel to the longitudinal direction of the frame.

The second seating portion may be disposed below the first seating portion in the securing space and protrude from an inner surface of the guide. A longitudinal direction of the second seating portion may be parallel to the longitudinal direction of the frame. Some area of a lower end of the frame may be seated on the second seating portion.

A dishwasher according to an embodiment may include a storage part in which a washing target is stored. The storage part may include a guide disposed in an edge area; a frame coupled to the guide; and a tray coupled to the frame. The tray may include a locking portion protruding from an edge area thereof and coupled to the frame, and configured to elevate the tray with respect to the frame. The frame may include a slot in which the locking portion is inserted; and a rail protruding toward the slot and forming some area of an outer shape of the slot, and configured to guide the movement of the locking portion and to suppress the locking portion from being separated from the slot.

A storage part according to another embodiment may include a guide disposed in an edge area; a frame coupled to the guide; and a tray coupled to the frame. The tray may include a locking portion protruding from an edge area thereof and coupled to the frame, and configured to elevate the tray with respect to the frame. The frame may include a slot in which the locking portion is inserted. The locking portion may include a hook secured to the slot and configured to suppress the locking portion from being separated from the slot.

In the dishwasher according to the present disclosure, the locking portion may have the hook structure configured to be locked to the rail and to move along the slot, thereby not escaping from the slot. Due to this structure, the hook may be locked to the rail even if the tray is partially deformed by repeated and continuous movement of the tray and dishes stored in the tray, thereby effectively suppressing the separation of the hook from the slot.

In addition, the tray and the frame may be coupled to each other by the simple method configured to locking the hook in the inserting portion in the dishwasher according to the present disclosure. Conversely, the tray and the frame may be decoupled from each other by separating the hook from the rail through the inserting portion. Accordingly, the coupling and decoupling process between the tray and the frame may become very convenient.

In addition, the horizontal movement range of the hook may be limited by appropriately presetting the length of the moving hole in the dishwasher according to the present disclosure. Accordingly, the dishwasher may effectively suppress the separation of the tray from the storage part even when the tray secured to the storage part is continuously and repeatedly used.

Specific effects are described along with the above-described effects in the section of Detailed Description.

DESCRIPTION OF REFERENCE NUMERALS

DESCRIPTION OF SPECIFIC EMBODIMENTS

Figure 1:
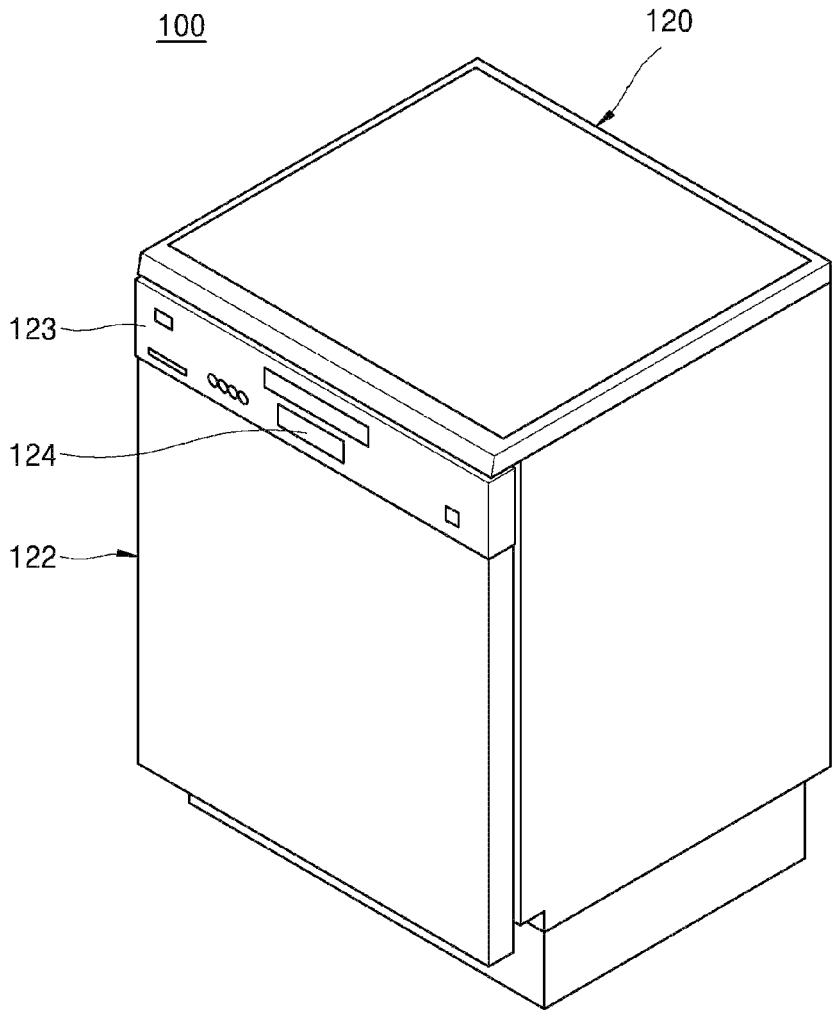
FIG. 1 is a perspective view showing a dishwasher according to an embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Throughout the present disclosure, "up-down direction (or a vertical direction)" means an up-and-down direction of a dishwasher that is installed for daily use. "Left-right direction (or horizontal direction)" means a direction orthogonal to the up-down direction, and "front-back direction means a direction orthogonal to both the up-down direction and the left-right direction. "Both side directions" or "lateral directions" have the same meaning as the left-right direction. These terms may be used interchangeably herein.

Figure 2:
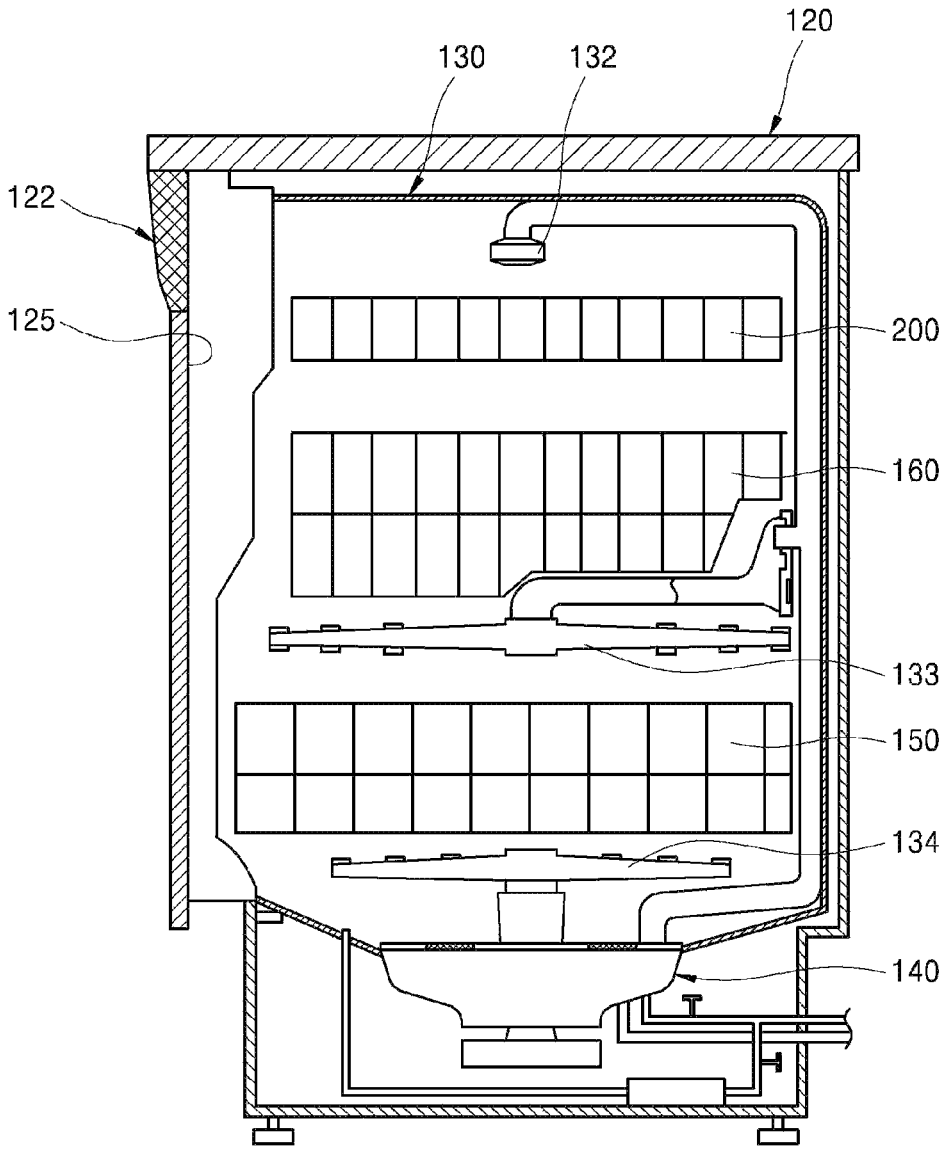
FIG. 2 is a schematically sectional view of a dishwasher according to an embodiment.

FIG. 1 is a perspective view showing a dishwasher 100 according to an embodiment. FIG. 2 is a schematically sectional view of a dishwasher 100 according to an embodiment.

As shown in FIGS. 1 and 2, the dishwasher 100 according to this embodiment may include a case 120 that defines an exterior design of the dishwasher; and a tub 130 provided in the case 120 and defining a washing space to wash washing targets such as dishes, with an open front surface.

In addition, the dishwasher 100 may include a door configured to open and close the open surface of the tub 130; and a drive unit 140 provided below the tub 130 and configured to supply, collect, circulate and discharge wash water for washing the dishes.

The dishwasher 100 may further include a plurality of storage parts 150, 160 and 200 releasably provided within the tub 130 to store washing targets such as dishes, and a plurality of spray parts 132, 133 and 134 disposed adjacent to the storage parts 150, 160 to spray wash water for washing dishes. At this time, the storage parts 150, 160 and 200 may be provided in the dishwasher to store dishes.

Here, the tub 130, the drive part 140 and each spray part among the structures of the dishwasher 100 described above may be implemented by the same or similar structures as those of the prior art, thereby omitting detained description thereof.

Meanwhile, the plurality of storage parts 150, 160 and 200 may be releasably provided inside the tub 130 to be removed through the open surface of the tub 130. The plurality of storage parts 150, 160 and 200 may include a first storage part 150 disposed in a lower region of the tub 130 to accommodate relative large dishes, a second storage part 160 disposed above the first storage part 150 to accommodate relatively small dishes, and a third storage part 200 disposed in an upper region of the tub 130 to accommodate dishes.

The plurality of spray parts 132, 133 and 134 may be configured to spray wash water toward the dishes stored in the storage parts 150, 160 and 200. The plurality of spray parts 132, 133 and 134 may include a lower spray part 134 disposed in a lower region of the tub 130 to spray wash water toward the first storage part 150, an upper spray part 133 disposed between the first storage part 150 and the second storage part 160 to spray wash water toward the first and second storage parts 150 and 160, and a top spray part 132 disposed in an upper region of the tub 130 to spray wash water toward the third storage part 200 or the second storage part 160

However, the top spray part 132 may not be an essential component for configuring the dishwasher 100, and may not be provided depending on embodiments.

Meanwhile, a guide configured to guide the introduction and discharging of the first, second and third storage parts 150, 160 and 200 may be provided in each of lateral walls of the tub 130. A guide mechanism 1310 for guiding the introducing and discharging of the third storage part 200 will be described later in detail, referring to drawings.

A door 122 may be configured to open and close the front of the tub 130 described above. In general, the door 122 may include a hinge portion provided in a lower region of the open surface to open and close the door 122 so that the door can be open with respect to the hinge portion functioning as a rotation axis.

In this instance, a handle 124 for opening the door 122 and a control panel 123 for controlling the dishwasher 100 may be provided on an outer lateral surface of the door 122. An inner lateral surface of the door 122 may form one surface of the tub 130 when the door 122 is close and at the same time form a seating surface on which the first storage part 150 can be seated when the door 122 is opened.

To this end, when the door 122 is opened, the seating surface of the door 122 may form a horizontal plane state extending to the guide through which the first storage part 150 is guided.

Meanwhile, the structure of the storage part and the structure related thereto according to the embodiment will be described below with respect to the third storage part 200. Hereinafter, the structure of the third storage part 200 and the related structure thereto will be described in detail, referring to the accompanying drawing. Hereafter, the third storage part 200 will be referred to as the storage part 200.

Figure 3:
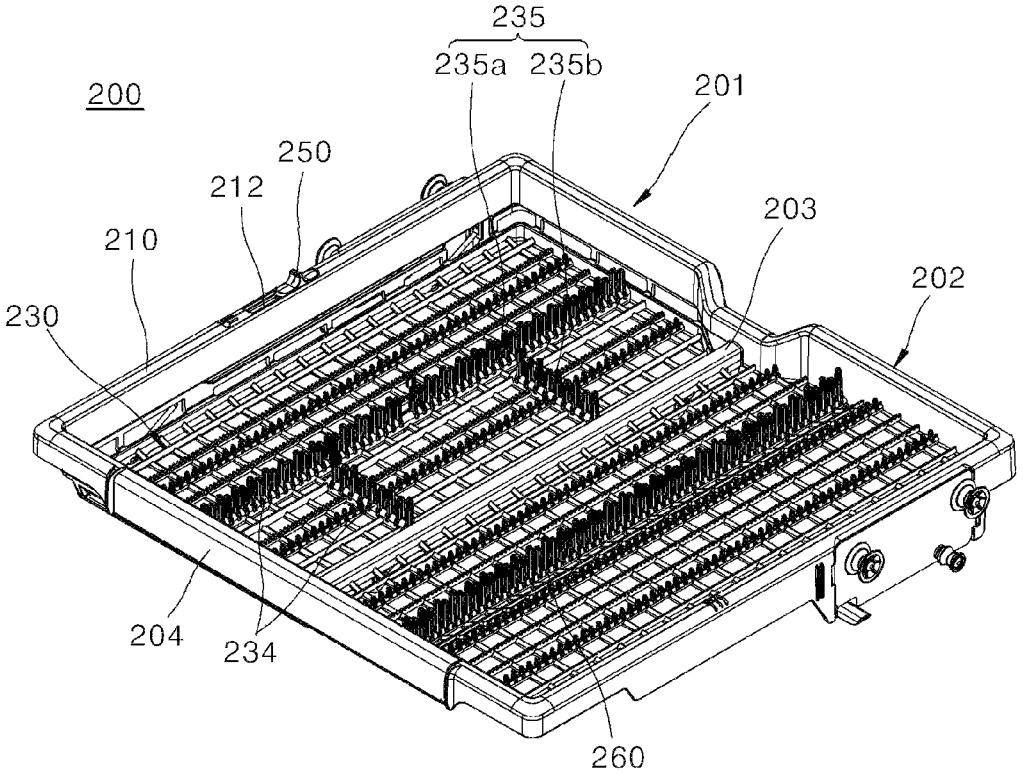
FIG. 3 is a perspective view of a storage part according to an embodiment.
Figure 4:
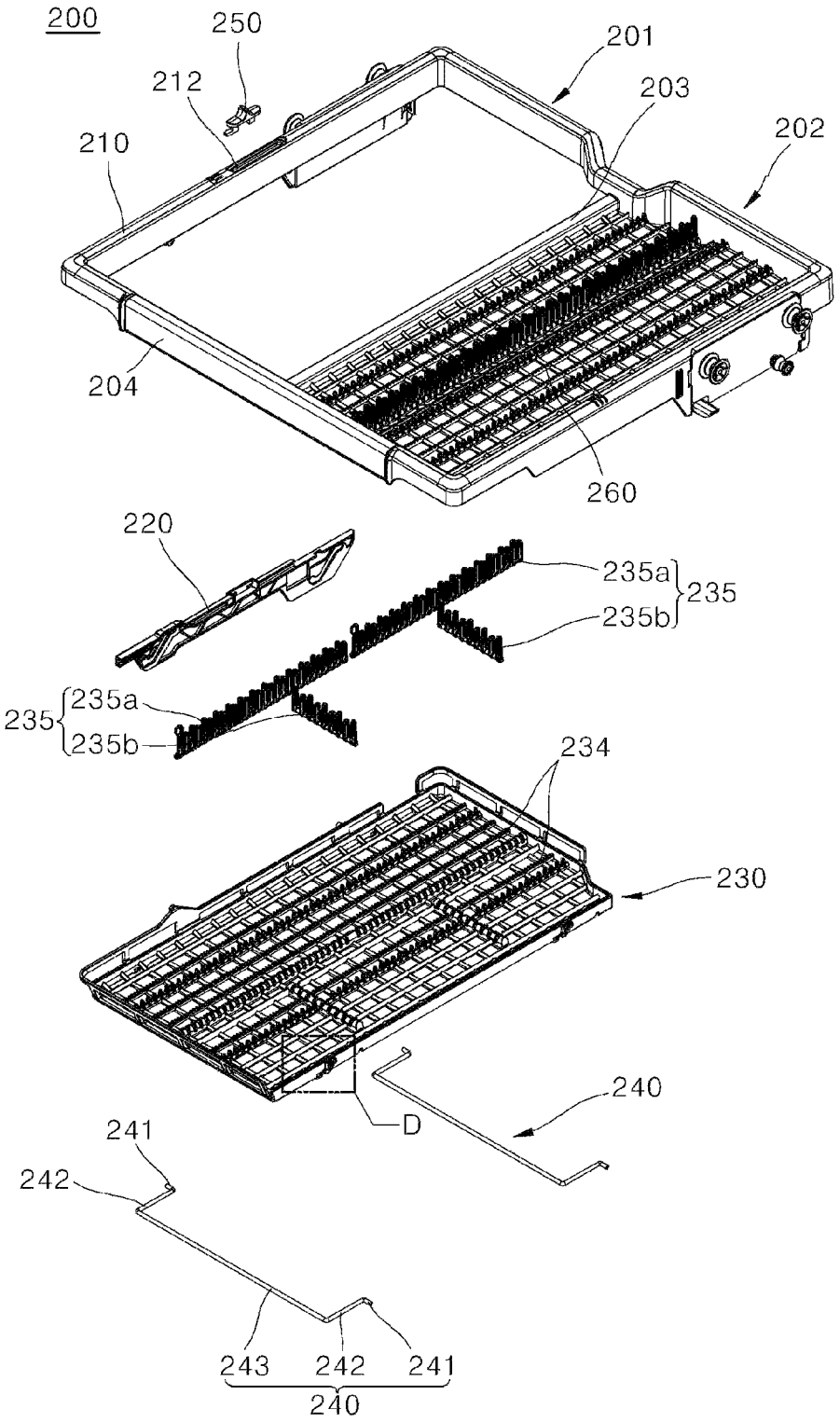
FIG. 4 is an exploded perspective view showing a storage part according to an embodiment.
Figure 5:
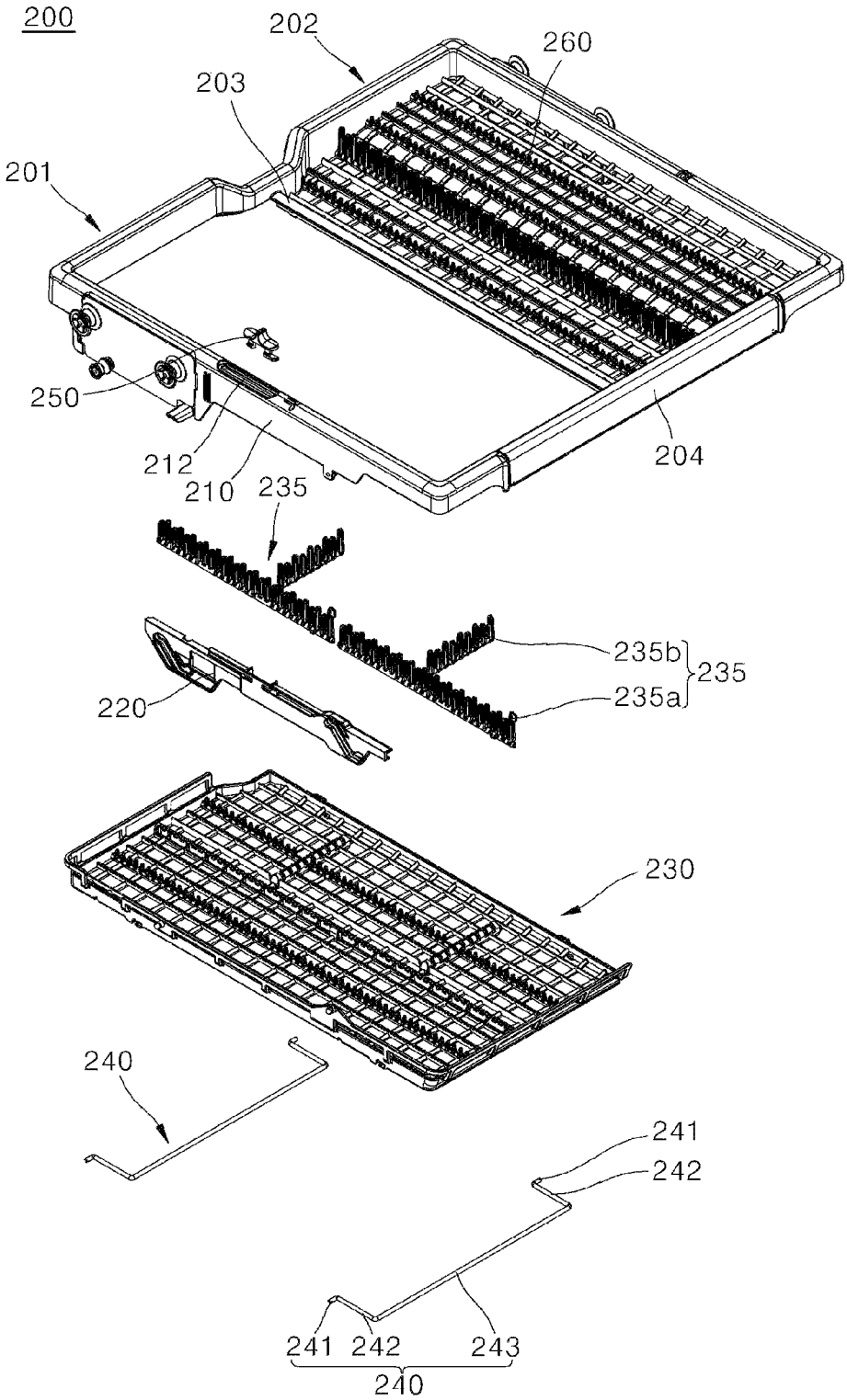
FIG. 5 is an exploded perspective view of FIG. 4, viewed from a different position.

FIG. 3 is a perspective view of a storage part according to an embodiment. FIG. 4 is an exploded perspective view showing a storage part according to an embodiment. FIG. 5 is an exploded perspective view of FIG. 4, viewed from a different position.

The storage part according to the embodiment may include a handle 204, a guide 210, a frame and a tray 230. The handle 204 may be provided in a front area of the storage part 200 so that the user can hold the handle 204 to insert the storage part 200 into the dishwasher 100 or take it out of the dishwasher 100.

The guide 210 may be disposed in an edge area of the storage part 200. The guide 210 may include a securing space 211 in which the frame 220 is secured. The frame 220 may be coupled to the guide 210 to be movable along a longitudinal direction of the guide 210.

The frame 220 may be movably secured to the guide 210 in a horizontal direction. The frame 220 may be configured to reciprocate in a longitudinal direction of the guide 210 and the tray 230 may be configured to elevate in a vertical direction of the storage part 200 along with the movement of the frame 220.

The tray 230 may be coupled to the frame 220 and configured to elevate along with the horizontal movement of the frame 220. Dishes may be stored in the tray 230 and the tray 230 may include tines and a base **230*a*** to accommodate dishes.

The base **230*a* may form a bottom area of the tray 230. The base 230*a* may be formed by crossing a plurality of horizontal bars and a plurality of vertical bars with each other. The horizontal bars and the vertical bars may be formed in a bar shape to make the entire lower surface of the base 230*a* in a mesh shape so that wash water may easily pass through the base 230*a***.

The storage part 200 may include a first region 201, a second region 202 and a partition bar 203. In the first region, the tray 230 may be disposed and the tray 230 disposed in the first region 201 may elevate by the user's manipulation.

The second region 202 may be separately provided from the first region 201. The horizontal bars and the vertical bars may be provided on a button of the second region to cross each other so that the wash water may smoothly pass through the bottom of the second region 202.

The second region 202 may include a fixed tine provided as a structure for storing dishes. The fixed tine 260 may be integrally formed with a bottom surface of the storage part 200. The fixed tine 260 may be provided in plural and the plurality of fixed tines may be aligned at preset intervals across the storage part 200.

The partition bar 203 may be configured to partition the first region 201 and the second region 202 from each other.

As shown in FIGS. 3 and 4, the partition bar 203 has the height measured in a vertical direction of the storage part 200 is relatively low enough not to interfere with the user's storing dishes. Accordingly, dishes may be stored in the first region 201 and the second region 202 separately or may be stored in the storage part 200 in a state of being placed over the first region 201 and the second region 202.

The storage part 200 may further include a link 240 configured to support horizontal movement and vertical movement of the tray 230 and having one end rotatably coupled to the guide 210 and the other end rotatably coupled to the partition bar 203.

The link 240 may be secured to a lower area of the tray 230 to support the tray 230, thereby suppressing the tray 230 from sagging downward or from being separated from the storage part 200 by the load of the dishes stored in the tray 230.

The link 240 may be fabricated by appropriately bending one long thin bar. The link 240 may include a first link 241, a second link 242 and a third link 243.

The first link 241 may be provided in a pair and the pair of first links 241 may be rotatably coupled to the guide 210 and the partition bar 203, respectively. The second link 242 may be provided in a pair and the pair of second links 242 may bent from each other.

The third link 243 may have both ends that are coupled to ends of the second links 242, respectively, and may be coupled to the tray 230 to crossingly support the tray 230.

As the tray 230 elevates, the link 240 may be rotated to move in response to the tray 230. Accordingly, even when the tray 230 elevates, the link 240 may be always supporting the lower area of the tray 230.

Specifically, when the tray 230 elevates, the first link 241 of the link 240 may be rotated with respect to the guide 210 and the partition bar 203 so that the entire link 240 can be rotated. At this time, the third link 243 supporting the tray 230 may elevate in response to the elevation of the tray 230 along the rotation of the link 240. Accordingly, when the tray 230 elevates, the third link 243 may elevate together to support the tray 230.

The link 240 may be provided in the storage part 200 in plural. The number of the links 240 may be appropriately selected in consideration of the size of the tray 230 and the load applied to the tray 230 by the dishes.

The storage part 200 may further include a button 250 secured to the frame 220 and configured to be manipulated by the user to move the frame 220 in a horizontal direction with respect to the guide 210.

The button 250 may be secured to the frame 220 through a moving hole 212 formed in the guide 210. The button 250 may be configured to horizontally reciprocate with respect to the guide 210 in the moving hole 212.

As the button 250 is moved in a horizontal direction, the frame 220 to which the button 250 is secured may be also moved in a horizontal direction with respect to the guide 210 only to elevate the tray 230 in a vertical direction.

The tray 230 may include a supporter portion 234 and a holder portion 235. The holder portion 235 may be secured to the support portion 234.

The supporter portion 234 may be coupled to the base 230*a*. The holder portion 235 may be secured to the supporter portion 234 and the support portion may support the rotation of the holder portion 235. The supporter portion 234 may protrude from the base 230*a*. For example, the support portion 234 may be integrally formed with the base 230*a* but the present disclosure may not be limited thereto.

The holder portion 235 may be secured to the supporter portion 234 and rotatable with respect to the supporter portion 234. When the user applies an external force thereto, the holder portion 235 may be rotated with respect to the supporter portion 234.

The holder portion 235 may include a first holder 235*a* and a second holder 235*b*. The longitudinal direction of the first holder 235*a* may be parallel to that of the guide 210. The first holder 235*a* may be provided in plural and the plurality of first holders 235*a* may be disposed at respective positions overlapping each other in a longitudinal direction.

The second holder 235*b* may be provided at a position spaced apart from the first holder 235*a* and the longitudinal direction of the second holder 235*b* may cross that of the guide 210. The second holder 235*b* may be provided in plural. At this time, the length of the first holder 235*a* may be greater than that of the second holder 235*b*.

The supporter portion 234 may be provided at a position corresponding to the first holder 235*a* and the second holder 235*b*. The supporter portion 234 may be provided in plural and the plurality of support portions 234 may be disposed with the length corresponding to the first holder 235*a* and the second holder 235*b*.

Figure 6:
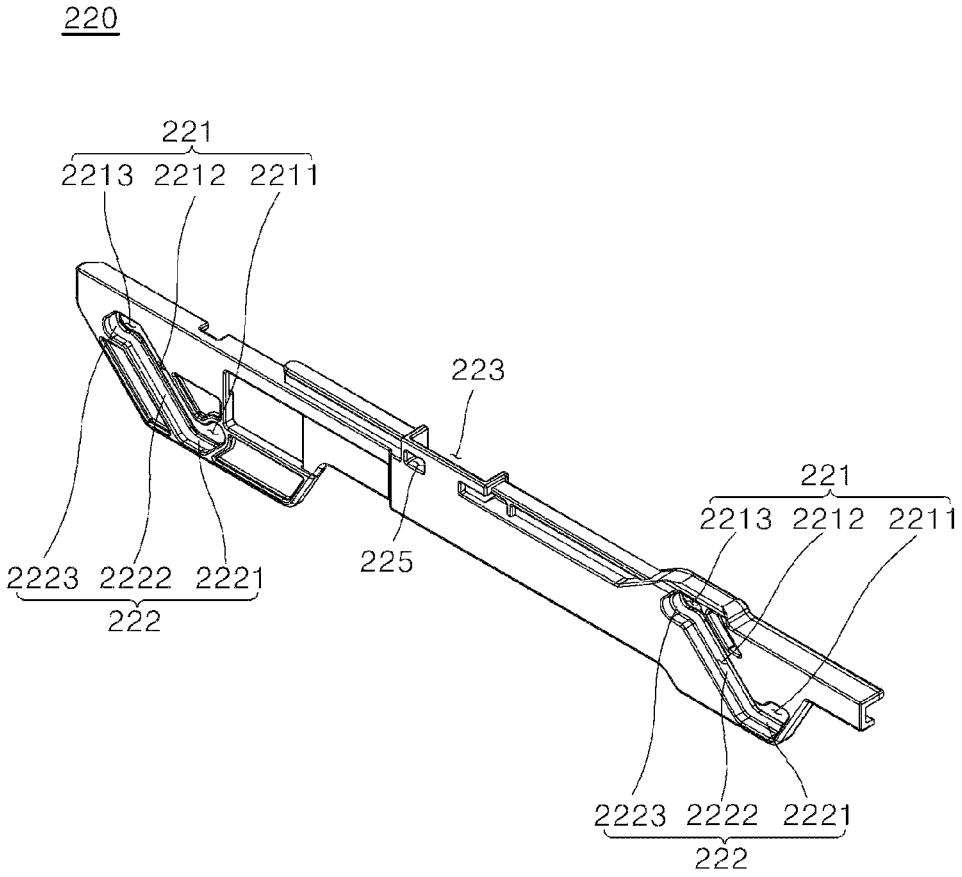
FIG. 6 is a perspective view showing a frame according to an embodiment.
Figure 7A:
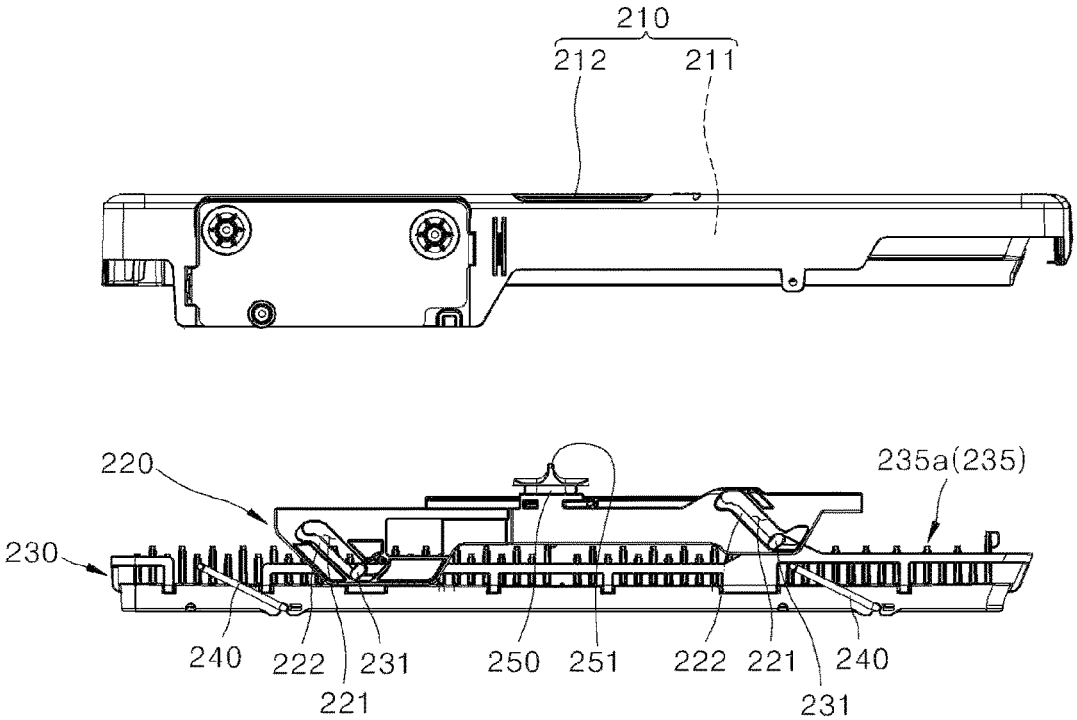
FIG. 7A is an exploded view showing an arrangement relation of components constituting a storage part according to an embodiment.
Figure 7B:
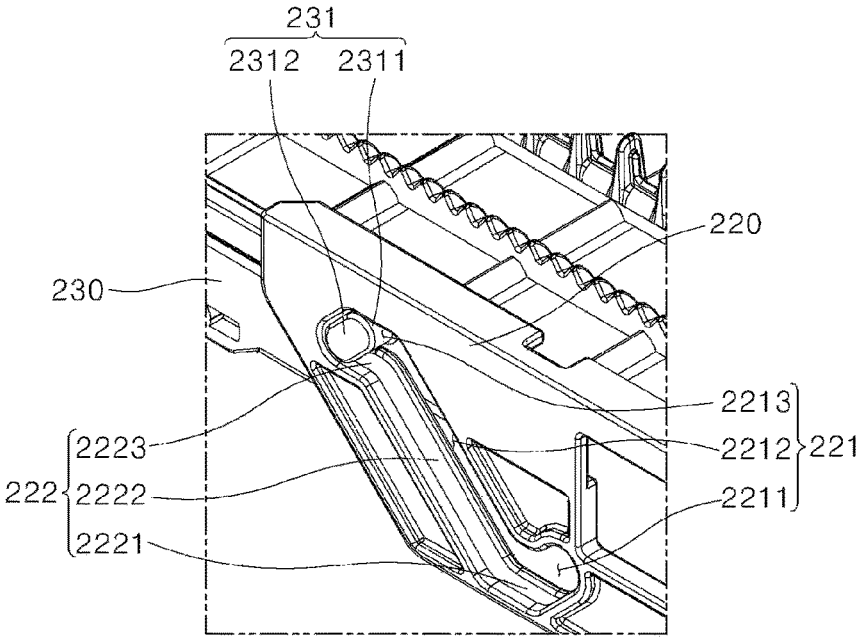
FIG. 7B is a perspective view showing a coupling structure between a frame and a tray.

FIG. 6 is a perspective view showing a frame 220 according to an embodiment. FIG. 7A is an exploded view showing an arrangement relation of components constituting a storage part 200 according to an embodiment. FIG. 7B is a perspective view showing a coupling structure between a frame 220 and a tray 230.

The tray 230 may include a locking portion 231 protruding from an edge area thereof and secured to the frame 220 to move in a direction inclined with respect to the frame 220 and elevate the tray 230.

When the frame 220 is moved in the horizontal direction, the locking portion 231 may be moved in the inclined direction with respect to the frame 220. The frame 220 may be secured to the guide 210 and movable with respect to the guide 210. When the frame 220 is moved in the horizontal direction, the vertical movement of the frame may be suppressed by the guide 210 so that the frame 220 cannot move in the vertical direction.

However, the vertical movement of the tray 230 may not be suppressed. When the frame 220 is moved in the horizontal direction, the locking portion 231 provided in the tray 230 may be moved in the inclined direction with respect to the frame 220 so that the tray 230 may elevate.

The frame 220 may include a slot 221 and a rail 222. The locking portion 231 may be inserted in slot 221 and the slot 221 may have an inclined area in the horizontal direction.

The rail 222 may protrude toward the slot 221 and define some area of an exterior of the slot 221. Also, the rail 222 may be configured to guide the movement of the locking portion 231 and suppress the locking portion 231 from being separated from the slot 221.

For the tray 230 to smoothly move with respect to the frame 220, the locking portion 231 may be provided in plural. The plurality of locking portions 231 may be spaced apart from each other in a horizontal direction of the tray 230.

The slot 221 and the rail 222 may be also provided in plural. Each of the slots 221 and the rails 222 may be disposed at a position corresponding to each of the locking portions 231.

The locking portion 231 may include a protrusion 2311 and a hook 2312. The protrusion 2311 and the hook 2312 may be integrally formed with the tray 230 but the present disclosure may not be limited thereto.

The protrusion 2311 may protrude from an edge area of the tray 230 and inserted in the slot 221. The hook 2312 may bend from the protrusion 2311 and have one lateral surface facing the rail 222.

The hook 2312 may be secured to the slot 221 and configured to suppress the locking portion 231 from being separated from the slot 221. In other words, the hook 2312 may be secured to the slot 221 for its movement to be locked by the rail 222 so that the hook 2312 may be suppressed from being separated from the slot 221. Accordingly, the locking portion 231 may be suppressed from being separated from the slot 221.

The slot 221 may include an inserting portion, an inclined portion 2212 and an upper end 2213. Some area of the inserting portion 2212 may be formed in a shape corresponding to the hook 2312, and the hook 2312 may be inserted in the inserting portion 2211.

The inclined portion 2212 may be connected to the inserting portion 2211 and inclined with respect to a horizontal direction of the frame 220. The top end 2213 may be connected to the inclined portion 2212 and form an upper end of the slot 221.

Since being inserted in the inserting portion 2211 and locked by the rail 222, the hook 2312 may be locked to the rail 222 so as to be moved along the slot 221. At this time, the hook 2312 may be locked to the rail 222 so that the locking portion 231 may not be separated from the slot 221 while moving along the slot 221, and the tray 230 may be stably moved upward.

In the embodiment, the locking portion 231 may have a hook structure (e.g., the hook 2312) to be hooked to the rail 222 and moved along the slot 221, thereby not being separated from the slot 221. Due to this structure, the hook 2312 may be locked to the rail 22 to be effectively suppressed from being separated from the slot 221, even if some area of the tray 230 is deformed by the repeated elevation of the tray 230 and the dishes stored in the tray 230.

The rail 222 may be formed in a shape corresponding to the entire shape configured of the inserting portion 2211, the inclined portion 2212 and the top end 2213. The rail 222 may include a hook locking portion 2221, a first bent portion 2222 and a second bent portion 2223.

The hook locking portion 2221 may have an upper end forming a lower end of the slot 221 to lock the hook 2312 inserted in the inserting portion 2211 downward. The hook locking portion 2221 may be formed at a position corresponding to the inserting portion 2211 of the slot 221.

The first bent portion 2222 may be bent from the hook locking portion 2221 and have one side forming some area of the inclined portion 2212 of the slot 221. The first bent portion 2222 may be formed at a position corresponding to the inclined portion 2212 of the slot 221.

The second bent portion 2223 may be bent from the first bent portion 2222 and configured to support the hook 2312 when the hook 2312 is placed at the uppermost end in the slot 221. The second bent portion 2223 may be formed at a position corresponding to the upper end of the slot 221.

In a state of being locked by the rail 222, the hook 2312 of the locking portion 231 may be guided by the rail 222 to reciprocate between the first bent portion 2222 and the second bent portion 2223. When the hook 2312 moves the first bent portion 2222 and the inclined portion 2212 of the slot 221 corresponding to the first bent portion, the tray 230 including the hook 2312 may be moved upward with respect to the frame 220.

Figure 8:
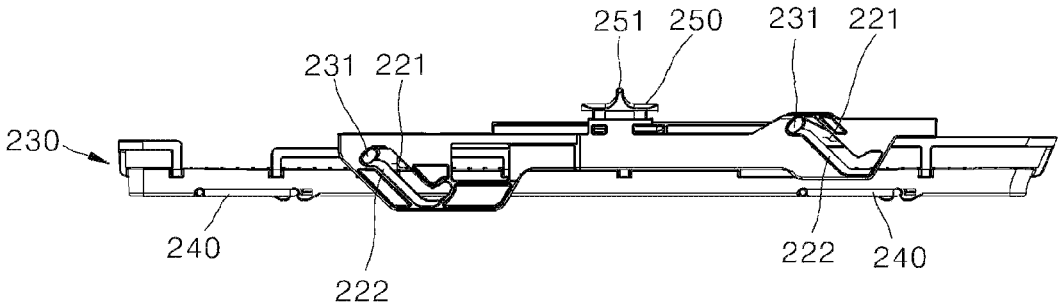
FIG. 8 is a side view showing a state where a frame is located in an elevated position with respect to the tray.
Figure 9:
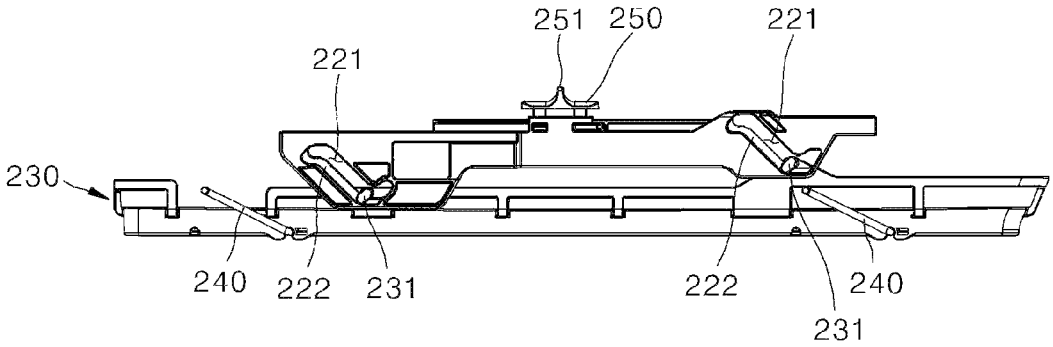
FIG. 9 is a side view showing a state where a frame is located in a lowered position with respect to the tray.

FIG. 8 is a side view showing a state where the frame 220 is located in an elevated position with respect to the tray 230. FIG. 9 is a side view showing a state where the frame 220 is located in a lowered position with respect to the tray 230.

The frame 220 may be movable in a horizontal direction with respect to the guide 210, in other words, a longitudinal direction of the guide 210. At this time, the frame 220 may be disposed in the securing space 211 provided in the guide 210 and moved inside the securing space 211. The guide 210 may not be moved in the vertical direction of the storage part regardless of the movement of the frame 220. Accordingly, the frame 220 secured to the guide 210 may not be moved in the vertical direction, while moved only in the horizontal direction.

Meanwhile, the locking portion 231 secured to the slot 221 of the frame 220 may be movable along the inclined portion 2212 of the slot 221. When the frame 220 is moved in a horizontal direction, the locking portion 231 may be elevated while being guided by the inclined portion 2212 of the slot 221. Accordingly, the tray 230 provided with the locking portion 231 may be also elevated.

As shown in FIG. 8, when the locking portion 231 of the tray 230 is positioned at the upper end that is the top of the slot 221, the tray 230 may be positioned at the top in a preset elevation range. As shown in FIG. 9, when the locking portion 231 of the tray 230 is positioned at the lower end of the inclined portion 2212 that is the bottom of the slot 221, the tray 230 may be positioned at the lowest point in the preset elevation range.

When the tray 230 is elevated, the link 240 may rotate with respect to the guide 210 and the partition bar 203. After that, the third link 243 of the link 240 secured to the lower area of the tray 230 to support the tray 230 may be elevated together with the tray 230 so as to always support the tray 230 even when the tray 230 is elevated.

Figure 10:
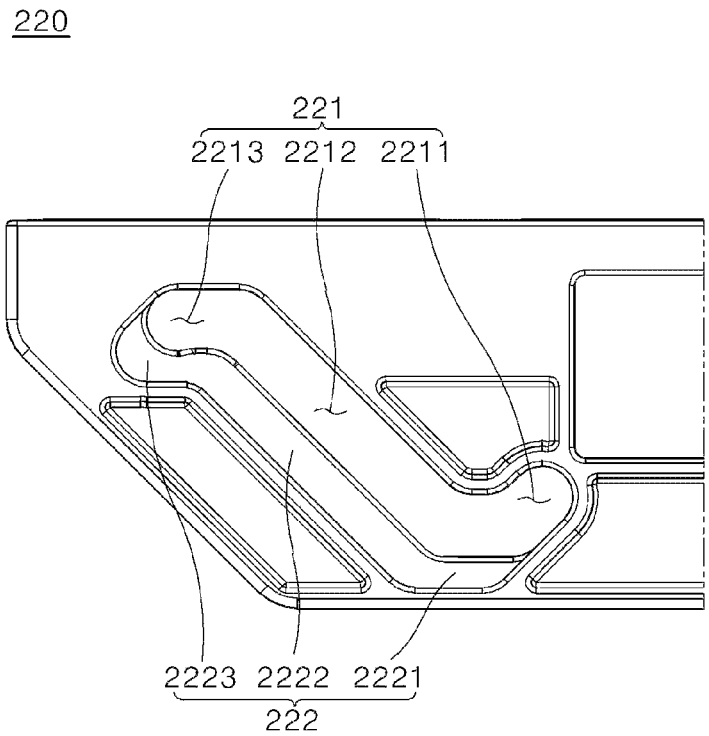
FIG. 10 is an enlarged view partially showing a frame according to an embodiment.
Figure 11:
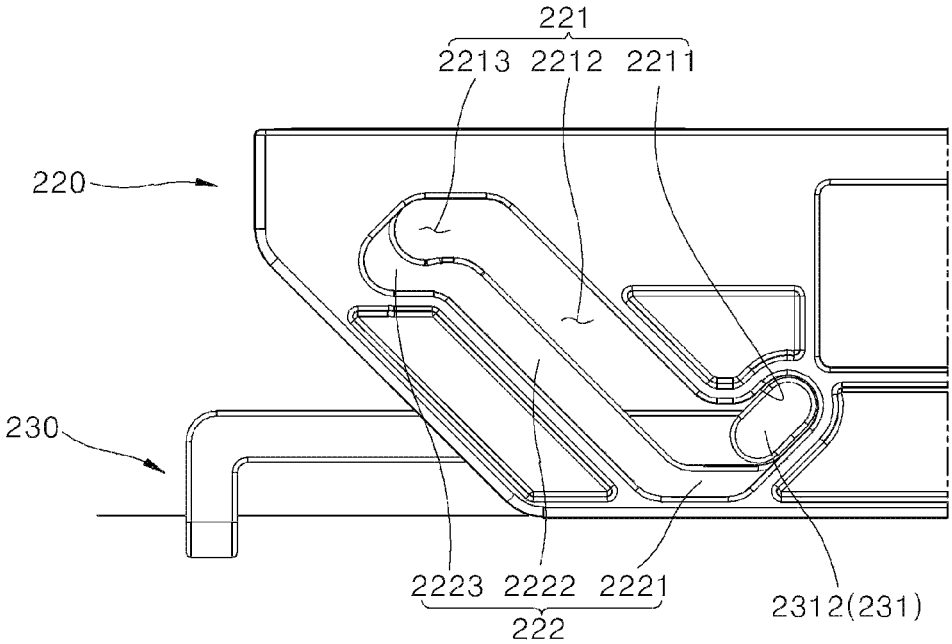
FIG. 11 is a view to describe a state where a frame is coupled to a tray.

FIG. 10 is an enlarged view partially showing a frame 220 according to an embodiment. FIG. 11 is a view to describe a state where the frame 220 is coupled to a tray 230. Hereinafter, referring to FIGS. 10 and 11, the assembling and dissembling process of the frame 220 and the tray 230 will be described.

The hook 2312 may be inserted in the inserting portion 2211 and then locked to the rail 222 so that the tray 230 and the frame 220 may be coupled to each other.

The inserting portion 2211 of the slot 221 may be inclined upward from a lower end of the inclined portion 2212. Accordingly, a sufficient space in which the hook 2312 of the locking portion 231 may pass through the slot 221 can be provided.

When the locking portion 231 is secured to the slot 221, the hook 2312 may be inserted in the inserting portion 2211 as shown in FIG. 11. Hence, the hook 2312 may be inserted in the inserting portion 2211 and then moved downward to be locked to the hook locking portion 2221 of the rail 222. Next, the button 250 may be inserted in the moving hole 212 of the guide 210 to be secured to the frame 220.

When the button 250 is secured to the frame 220, the assembling process of coupling the tray 230 to the frame 220 may be completed. When the hook 2312 is locked to the hook locking portion 2221 of the rail 222, the hook 2312 may be locked by the rail 222 to be movable along the hook locking portion 2221, the first bent portion 2222 and the second bent portion 2223.

When the button 250 is secured to the frame 220, the horizontal movement range L1 of the button 250 may be limited by the moving hole 212 having the limited length. Since the horizontal movement range of the hook 2312 is limited, the hook 2312 may not reach the inserting portion 2211 and the separation of the hook 2312 from the frame through the inserting portion 2211 can be suppressed. Such the assembling process may be manually performed by the user.

Meanwhile, as the hook 2312 is separated from the inserting portion 2211, the tray 230 may be decoupled from the frame 220.

In case of decoupling the tray 230 from the frame 220, the button 250 may be separated from the frame 220. When the button 250 is separated, the limitation of the horizontal movement range of the hook 2312 may be released.

To separate the hook 2312, the hook 2312 may be moved to the lower end of the inclined portion 2212. Once the button 250 is already separated, the hook 2312 may be movable to the inserting portion 2211.

Accordingly, the hook 2312 may be moved upward again from the lower end of the inclined portion 2212 and then reach the inserting portion 2211 after getting out of the hook locking portion 2221 of the rail 222 to be located at a position shown in FIG. 11. When the hook 2312 is separated from the inserting portion 2211 after that, the decoupling process of the tray 230 and the frame 220 may be completed. The decoupling process may be performed manually by the user.

In the embodiment, the tray 230 and the frame 220 may be coupled to each other by the simple process of locking the hook 2312 to the rail 222 through the inserting portion 2211. Conversely, the tray 230 and the frame 220 may be decoupled from each other by separating the hook 2312 from the rail 222 after escaping through the inserting portion 2211. Accordingly, the coupling and decoupling between the tray 230 and the frame 220 may be performed very conveniently.

Figure 12:
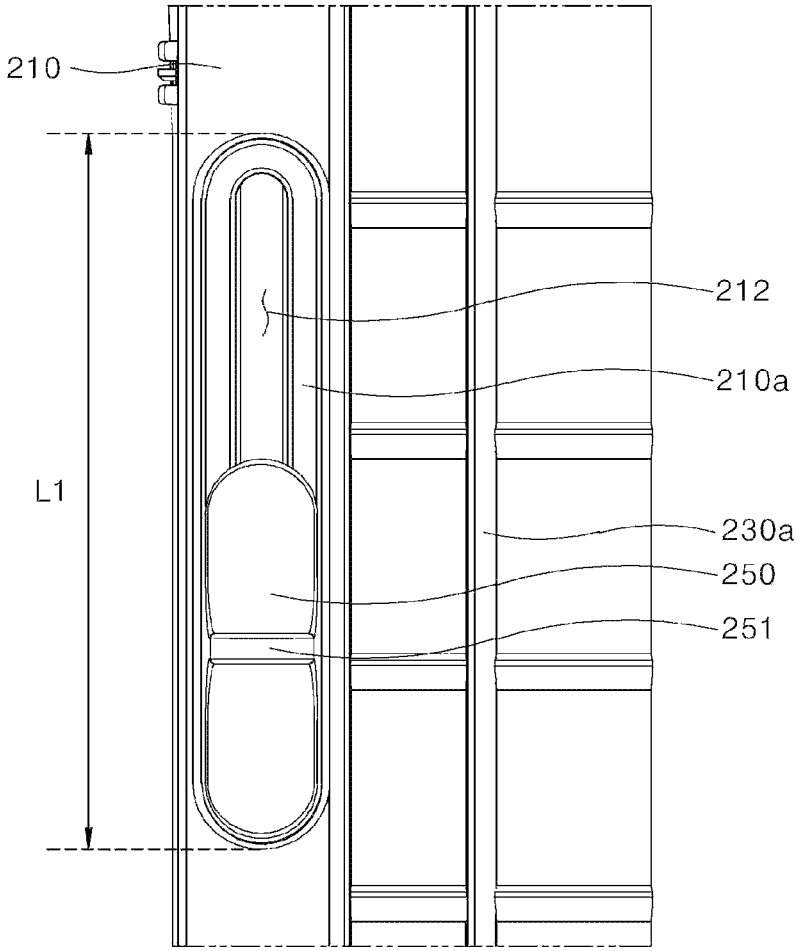
FIG. 12 is a plane view showing a state where a button is coupled to a guide.
Figure 13:
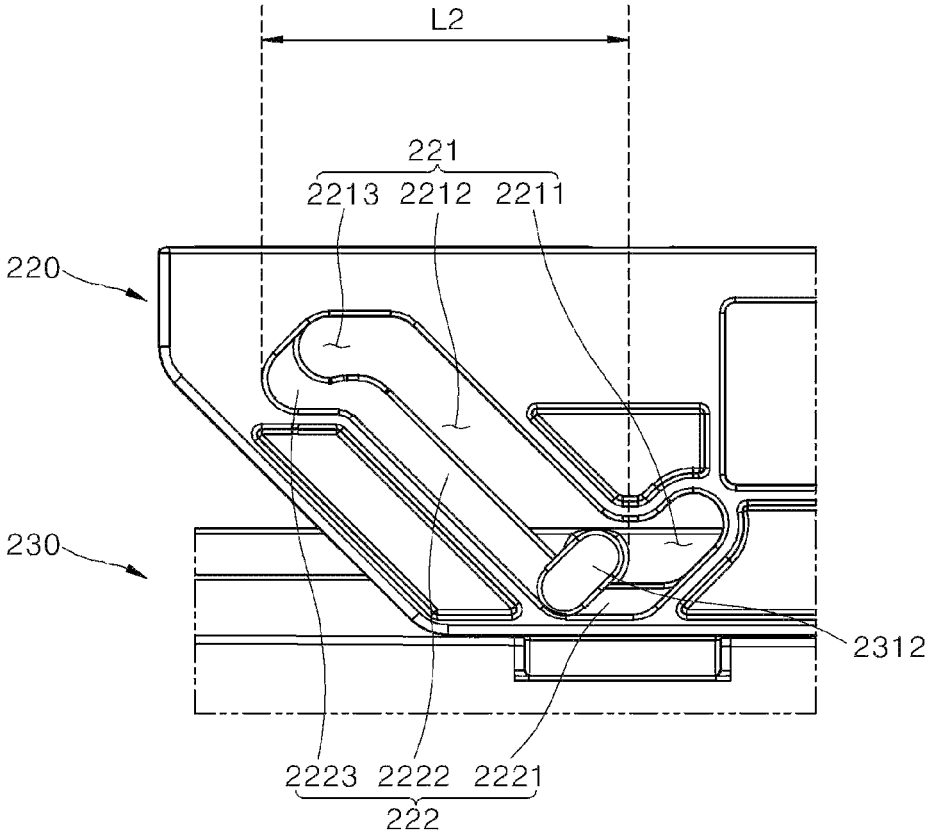
FIG. 13 is a side view showing a state where a frame is located in an uppermost position with respect to a tray.
Figure 14:
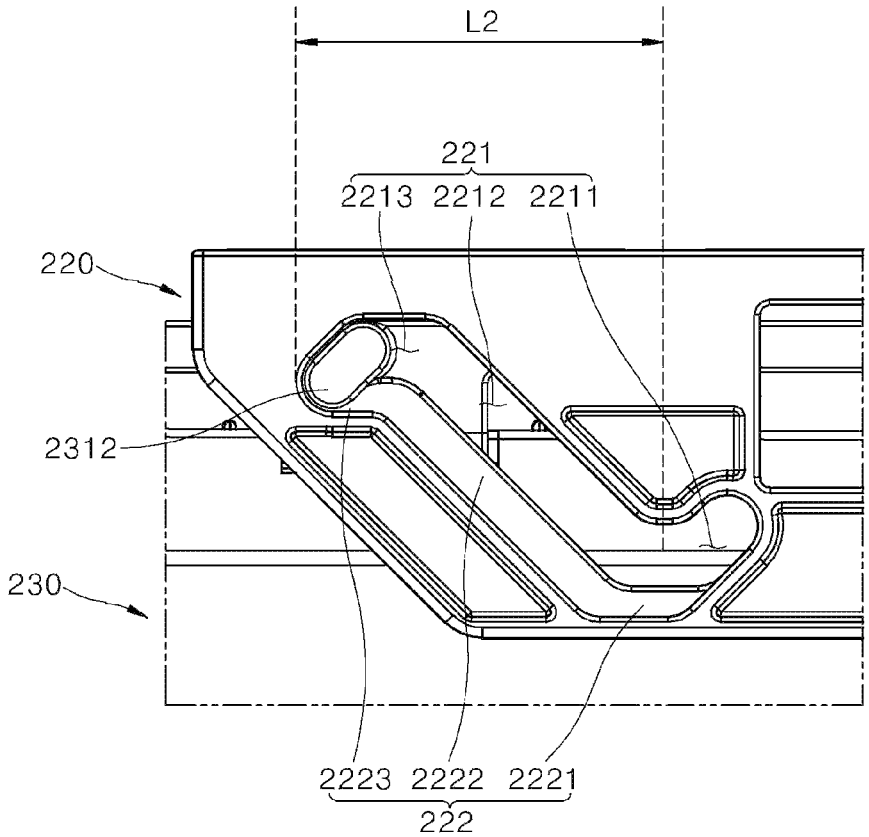
FIG. 14 is a side view showing a state where a frame is located in a lowermost position with respect to a tray.

FIG. 12 is a plane view showing a state where a button 250 is coupled to a guide 210. FIG. 13 is a side view showing a state where the frame 220 is located in an uppermost position with respect to the tray 230. FIG. 14 is a side view showing a state where the frame 220 is located in a lowermost position with respect to the tray 230.

The guide 210 may include the securing space 211 (see FIG. 21) and a moving hole 212. The securing space 211 may be formed inside the guide 210 and the frame 220 may be secured therein to provide a predetermined space for moving in a horizontal direction.

The moving hole 212 may be configured to be connected with the securing space 211 and define a predetermined space in which the button 250 disposed therein can horizontally move. Some area of the button 250 may be inserted in the moving hole 212 to be coupled to the frame 220 disposed in the securing space 211.

As shown in FIG. 12, a stepped portion 210*a* may be formed around the moving hole 212. The stepped portion 210*a* may define an outer shape of the moving hole 212 and an upper surface of the stepped portion 21*a* may be configured to support an upper area of the button 250.

Due to the stepped portion 210*a*, the upper area of the button 250 including a manipulation protrusion 251 may not be inserted in the securing space 211 and a state of being exposed to the upper surface of the guide 210.

The moving hole 212 may be formed with a preset length long enough to limit the horizontal movement range of the button 250. The horizontal movement range of the hook 2312 may be configured to be limited based on the horizontal movement range L1 of the button 250.

The horizontal movement range of the hook 2312 may not reach the inserting portion 2211 of the slot 221, in a state where the frame 220 is secured to the guide 210 and the button 250 is secured to the frame 220.

Since the length of the moving hole 212 is limited, the horizontal movement range L1 of the button 250 may be limited. Since the horizontal movement range L1 of the button 250 is limited, the horizontal movement range of the frame 220 moving together with the button 250 may be also limited.

The hook 2312 may be movable relatively with respect to the frame 220 as the frame moves in the horizontal direction. Accordingly, the horizontal movement range L2 of the hook 2312 may be equal to the horizontal movement range of the frame 220.

The frame 220 may be secured to the guide 210 and the hook 2312 may be inserted in the slot 221 of the frame 220. In a state where the button 250 is secured to the frame 220, the horizontal movement range L2 of the hook 2312 with respect to the frame 220 may be limited.

At this time, as shown in FIGS. 13 and 14, the length of the moving hole 212 may be preset to limit the horizontal movement range L2 of the hook 2312 to the upper end 2213 from the inclined portion 2212 of the slot 221, in other words, to the range for maintaining the state of locking the hook 2312 to the rail 222.

Accordingly, in the state where the frame 220 is secured to the guide 210 and the hook 2312 is inserted in the slot 221 and the button 250 is secured to the frame 220, the hook 2312 may not reach the inserting portion 2211 and the hook 2312 may be separated from the rail 222 even in case of using the tray 230 repeatedly.

In the embodiment, the horizontal movement range L2 of the hook 2312 may be limited by appropriately setting the length of the moving hole 212 so that the tray 230 may be effectively suppressed from being separated from the storage part 200 even if the tray 230 is repeatedly used in a state of being secured to the storage part 200.

Figure 15:
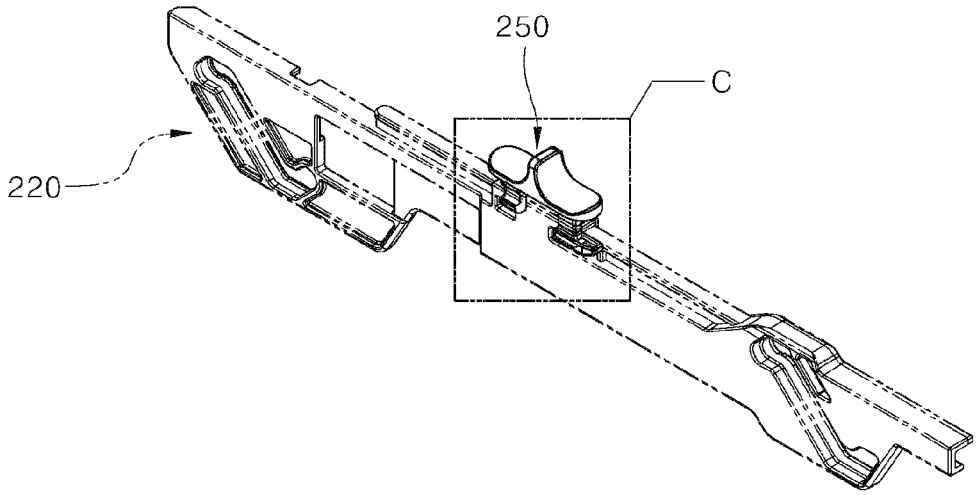
FIG. 15 is a perspective view showing a state where a button is coupled to a frame.
Figure 16:
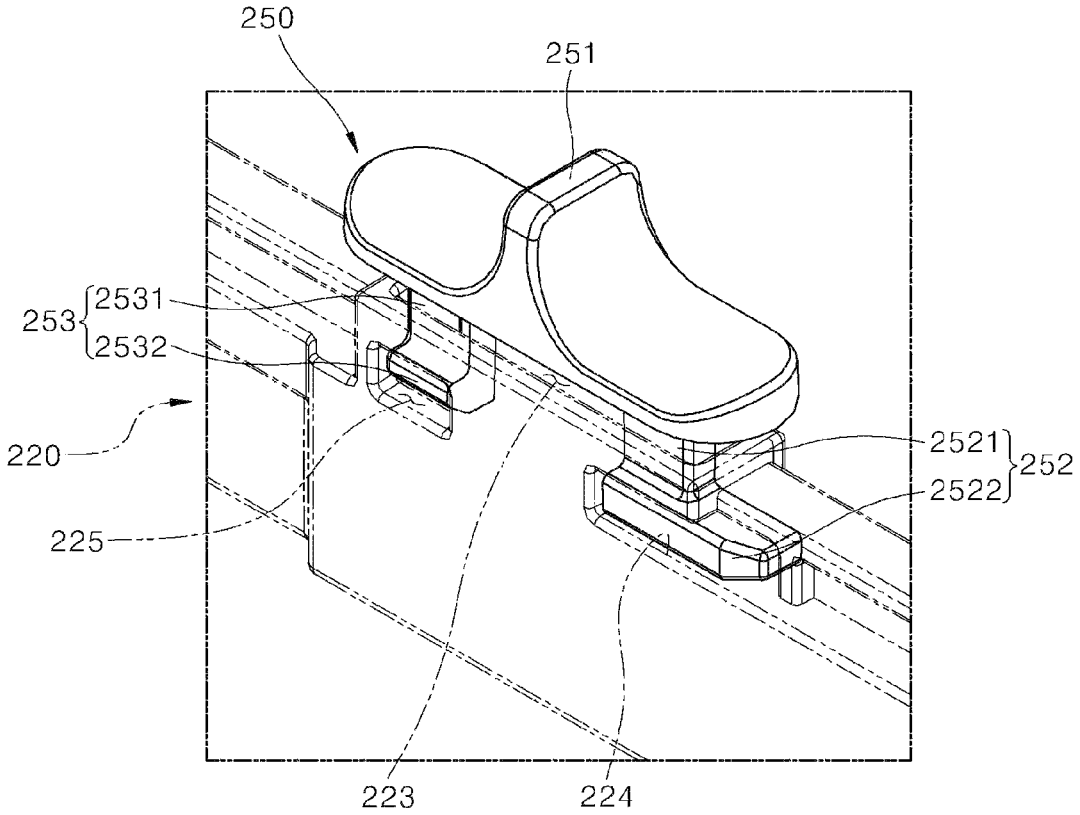
FIG. 16 is a view showing 'C' of FIG. 15.
Figure 17:
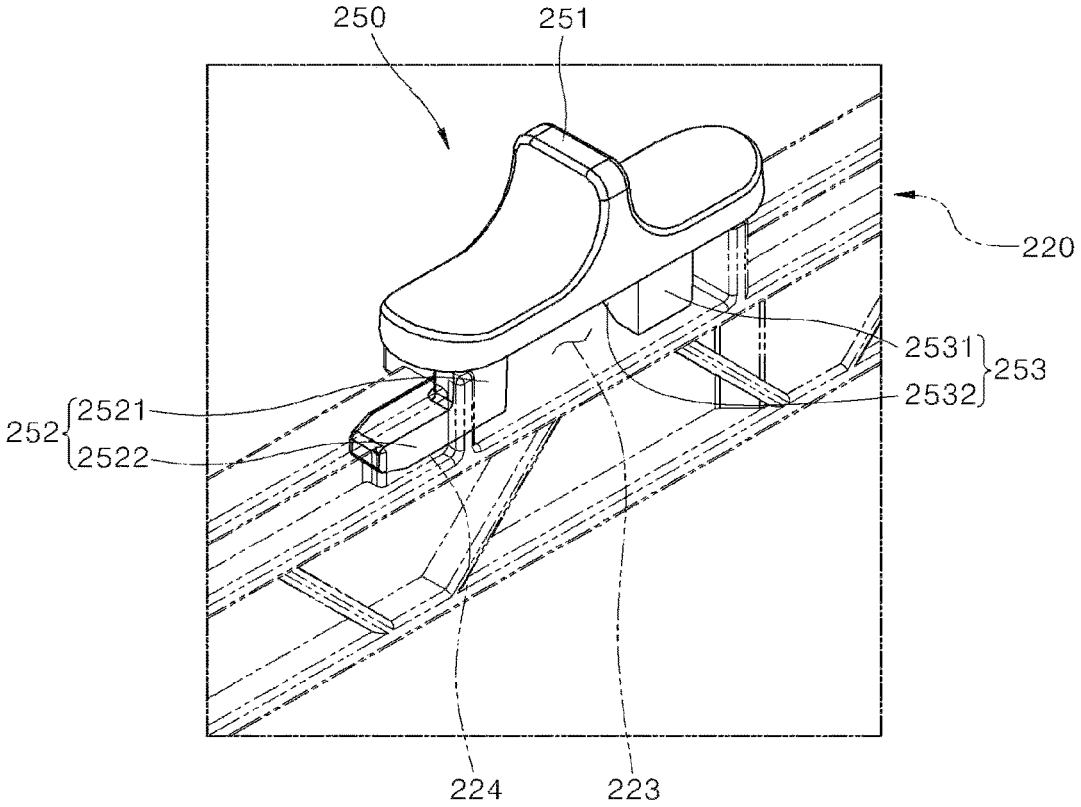
FIG. 17 is a view of FIG. 16, viewed from a different position.

FIG. 15 is a perspective view showing a state where a button 250 is coupled to a frame 220. FIG. 16 is a view showing 'C' of FIG. 15. FIG. 17 is a view of FIG. 16, viewed from a different position.

The button 250 may include a manipulation protrusion 251, a first fitted portion 252 and a second fitted portion 253. The manipulation protrusion 251 may protrude upward from a center of the button 250. When moving the frame 220 in the horizontal direction by touching the manipulation protrusion 251, the user may adjust the elevation of the tray 230 conveniently.

The first fitted portion 252 may some area fitted to the frame 220 in the longitudinal direction of the frame 220. The second fitted portion 253 may have some area fitted to the frame 220 in a direction crossing the longitudinal direction of the frame 220.

The first fitted portion 252 and the second fitted portion 253 may be stably coupled to the frame 220 by a shape fitting method and a forcibly fitting method. Of course, the first fitted portion 252 and the second fitted portion 253 may be detachably provided in the frame 220.

The first fitted portion 252 may be fitted along the longitudinal direction of the frame 220 and the second fitted portion 253 may be fitted in a direction crossing the longitudinal direction of the frame 220. Accordingly, even if an external impact such as the wash water sprayed during the operation of the dishwasher 100 or other impacts are applied to the button 250, the button 250 may be stably coupled to the frame 220 enough not to be separated therefrom.

The first fitted portion 252 may include a first projection 2521 and a first frame fitted portion 2522. The first projection 2521 may protrude in a downward direction of the button 250. The first frame fitted portion 2522 may be bent from the first projection 2521 in the longitudinal direction of the frame 220 to be fitted to the frame 220.

The second fitted portion 253 may include a second projection 2531 and a second frame fitted portion 2532. The second projection 2531 may be spaced apart from the first projection 2521 and protrude downward with respect to the button 250. The second frame fitted portion 2532 may be bent from the second projection 2531 in a direction crossing the longitudinal direction of the frame 220 to be fitted to the frame 220.

The frame 220 may include a first groove 223, a second groove 224 and a third groove 225. The first groove 223 may be formed by recessing the upper end of the frame 220 and the first projection and the second projection 2531 may be disposed in the first groove 223.

The second groove 224 may be connected to the first groove 223 and recessed in the longitudinal direction of the frame 220 to be positioned adjacent to the first frame fitted portion 2522. The third groove may be connected to the first groove 223 and recessed in a direction crossing the longitudinal direction of the frame 220, so that the second frame fitted portion 2532 may be fitted to the third groove 225.

The first frame fitted portion 2522 may be coupled to the second groove 224 and the second frame fitted portion 2532 may be coupled to the third groove 225 by a shape fitting method or a forcibly fitting method, so that the button 250 may be coupled to the frame 220 stably and firmly.

For example, the first frame fitted portion 2522 may be coupled to the second groove 224 and the second frame fitted portion 2532 may be then coupled to the third groove 225 by appropriately changing the overall position of the button 250. Accordingly, the button 250 may be coupled to the frame smoothly and easily.

Conversely, the second frame fitted portion 2532 may be coupled to the third groove 225 and the first frame fitted portion 2522 may be coupled to the second groove 224 after that. The process of separating the button 250 from the frame 220 may also be performed in a similar manner to the coupling process described above.

Figure 18:
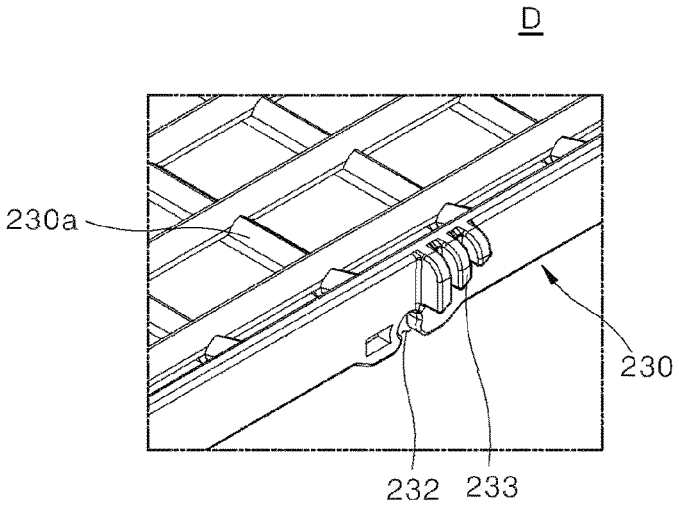
FIG. 18 is an enlarged view showing 'D' of FIG. 4.
Figure 19:
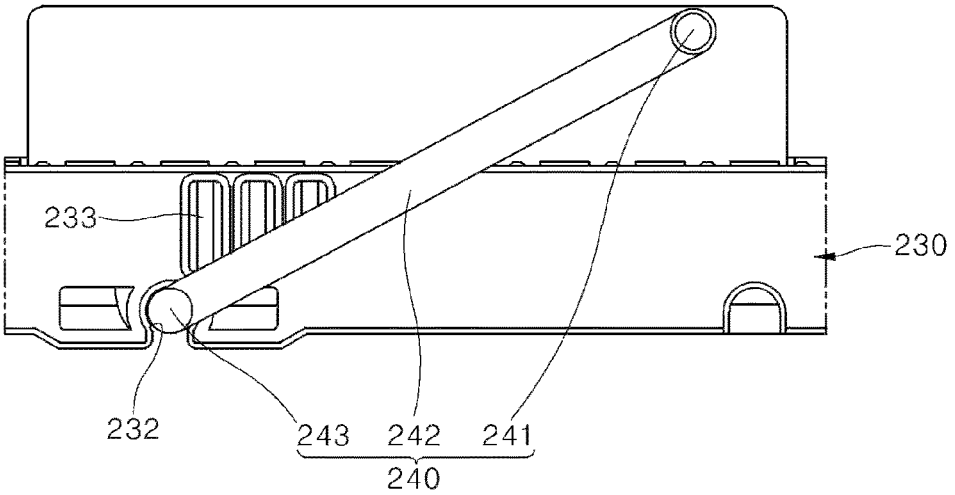
FIG. 19 is a view showing a state where a link is coupled to a tray.

FIG. 18 is an enlarged view showing 'D' of FIG. 4. FIG. 19 is a view showing a state where the link 400 is coupled to the tray 230.

The tray 230 may include a securing hole 232 and a rotation limiting portion 233. The securing hole 232 may be formed in a lower area of the tray 230 and the third link 243 of the link 240 may be secured in the securing hole 232. Accordingly, the third link 243 may be easily coupled or decoupled from the tray 230.

The rotation limiting portion 233 may have a lower surface configured to contact with the second link 242 to limit the rotation range of the second link 242. The rotation limiting portion 233 may protrude from an edge area of the tray 230 and disposed at a position getting in contact with the third link, with a lower surface that is inclined with respect to the horizontal direction of the tray 230.

For example, the rotation limiting portion 233 may be integrally formed with the tray 230 by injection molding. The rotation limiting portion 233 may be formed in one side of the tray that faces the guide 210 or the other side thereof that faces the partition bar 203.

Alternatively, rotation limiting portions 233 may be formed in both sides of the tray 230, that is, the both sides facing the guide 210 and the partition bar 203, respectively.

When the tray 230 is moved downward and located at the lowest position in the storage part 200, the inclined lower surface of the rotation limiting portion 233 and the second link 242 of the link 240 may get in contact with each other. When the rotation limiting portion 233 and the second link 242 are in contact with each other, the link 240 may stop the rotation and the tray 230 may also stop the downward movement.

As described above, the rotation limiting portion 233 may suppress the excessive downward movement of the tray 230, only to effectively suppress the components of the storage part 200 such as the tray 230 from getting damaged or deformed or the tray 230 from being separated from the storage part 200.

Figure 20:
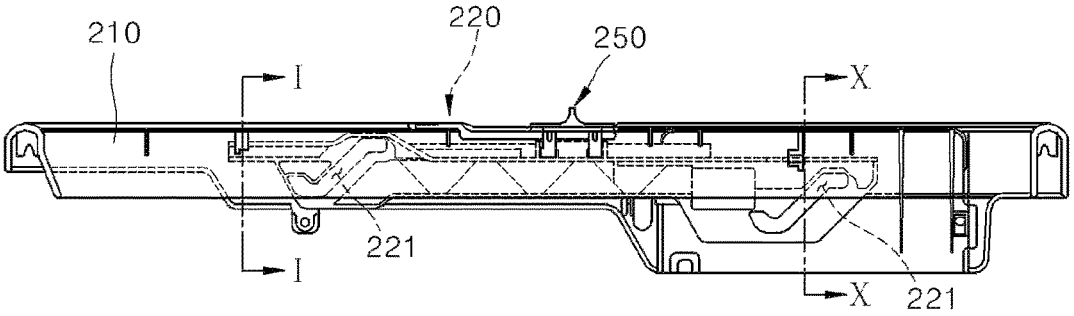
FIG. 20 is a view showing a state where a frame is coupled to a tray is coupled to a guide.
Figure 21:
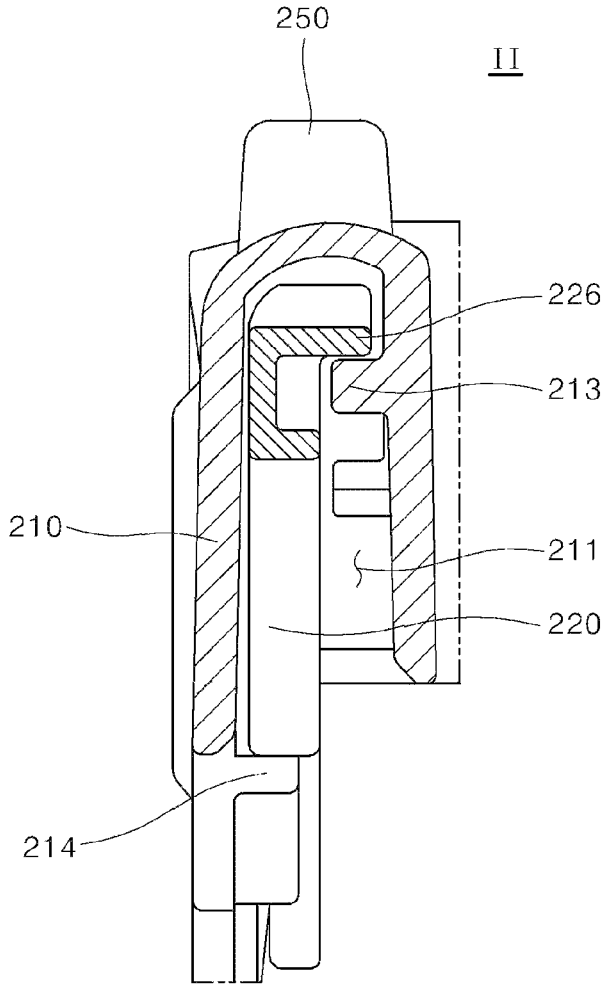
FIG. 21 is a sectional view, along an I-I direction of FIG. 20.
Figure 22:
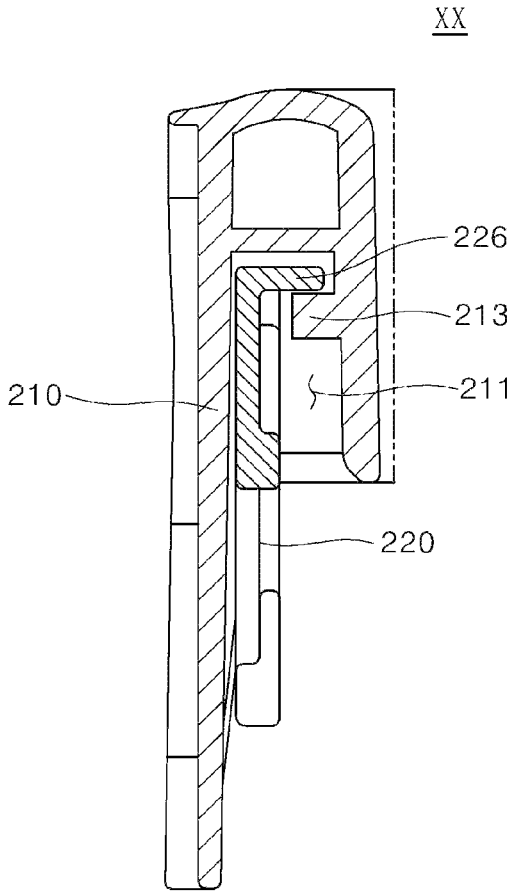
FIG. 22 is a sectional view along an X-X direction of FIG. 20.

FIG. 20 is a view showing a state where the frame 220 is coupled to a tray is coupled to the guide 210. FIG. 21 is a sectional view along I-I direction of FIG. 20. FIG. 22 is a sectional view along an X-X direction of FIG. 20.

The guide 210 may include a securing space 211, a first seating portion 213 and a second seating portion 214. The securing space 211 may be formed inside the guide 210 as a predetermined space. The frame 220 may be movably secured in the securing space 211 in a horizontal direction.

The first seating portion 213 may be disposed in the securing space 211 and protrude from an inner surface of the guide 210. A longitudinal direction of the first seating portion may be parallel to the longitudinal direction of the frame 220 and the frame 220 may be seated in the first seating portion 213.

The first seating portion 213 may be disposed at a position corresponding to an upper area of the guide 210. Accordingly, the frame 220 may be horizontally moved with respect to the guide 210 while being supported by the first seating portion 213 at the upper area of the frame 220.

The second seating portion 214 may be disposed below the first seating portion 213 in the securing space 211, and protrude from an inner surface of the guide 210. A longitudinal direction of the second seating portion 214 may be parallel to the longitudinal direction of the frame 220 and the lower end of the frame 220 may be partially seated in the second seating portion 214.

The second seating portion 214 may be disposed at a position corresponding to a lower area of the guide 210. Accordingly, the frame 220 may be horizontally moved with respect to the guide 210 while being supported by the first seating portion 213 at the lower area of the frame 220.

Some area of the lower end of the frame 220 may be configured to be placed on an upper surface of the second seating portion 214. Accordingly, some area of the lower end of the frame 220 may be supported by the second seating portion 214 so that the frame 220 may e stably movable in the horizontal direction with respect to the guide 210.

The frame 220 may further include a supporting rail 226 protruding from one side of the frame 220, and having a longitudinal direction parallel to the longitudinal direction of the frame 220 and a lower surface seated on an upper surface of the first seating portion 213.

When the frame 220 is secured to the guide 210 by a shape fitting method, the supporting rail 226 of the frame 220 and the first seating portion 213 of the guide 210 may be in contact.

The supporting rail 226 of the frame 220 may have the lower surface seated on the upper surface of the first seating portion 213. Due to this structure, the supporting rail 226 may be supported by the first seating portion 213 so that the frame 220 may stably move in the horizontal direction with respect to the guide 210.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A dishwasher comprising a storage part, wherein the storage part is configured to accommodate a washing target, the storage part comprising:

a guide disposed at an edge area of the storage part;

a frame coupled to the guide; and a tray coupled to the frame, wherein the tray comprises a locking portion that protrudes from an edge area of the tray and is movably coupled to the frame, the locking portion being configured to elevate the tray with respect to the frame, wherein the frame defines a slot that receives the locking portion, wherein the frame comprises a rail that defines at least a portion of an outer shape of the slot and has a surface spaced apart from the slot, the rail being configured to guide movement of the locking portion and to restrict the locking portion from being separated from the slot, wherein the locking portion comprises:

a protrusion that protrudes from the edge area of the tray and is inserted in the slot, and a hook that is curved from the protrusion and faces the rail, the hook being hooked to the rail and configured to move along the slot.

2. The dishwasher of claim 1, wherein the slot comprises:

an inserting portion configured to receive the hook, the insertion portion having a shape corresponding to the hook;

an inclined portion connected to the inserting portion and inclined with respect to a horizontal direction of the frame; and an upper end that is connected to the inclined portion and defines a top of the slot.

3. The dishwasher of claim 2, wherein the tray and the frame are configured to couple to each other based on the hook being inserted in the inserting portion and locked to the rail, and wherein the tray and the frame are configured to decouple from each other based on the hook being separated from the inserting portion.

4. The dishwasher of claim 2, wherein the rail comprises:

a hook locking portion configured to lock downward the hook inserted in the inserting portion, the hook locking portion having an upper end that defines a bottom end of the slot;

a first bent portion that is bent from the hook locking portion and defines an area of the inclined portion of the slot; and a second bent portion that is bent from the first bent portion and configured to support the hook based on the hook being placed on a top end of the slot.

5. The dishwasher of claim 2, wherein the storage part further comprises a button coupled to the frame and configured to be manipulated by a user to thereby move the frame in the horizontal direction with respect to the guide.

6. The dishwasher of claim 5, wherein the guide defines:

a securing space configured to guide the frame based on the frame moving horizontally with respect to the guide; and a moving hole connected to the securing space and configured to guide the button based on the button moving horizontally with respect to the frame.

7. The dishwasher of claim 6, wherein the moving hole has a preset length that limits a horizontal movement range of the button, and wherein the horizontal movement range of the button defines a horizontal movement range of the hook.

8. The dishwasher of claim 7, wherein the horizontal movement range of the hook is defined such that the hook does not reach the inserting portion of the slot based on the frame being fixed to the guide and the button being fixed to the frame.

9. The dishwasher of claim 6, wherein the guide comprises:

a first seating portion that is disposed in the securing space and protrudes from an inner surface of the guide to the securing space, the first seating portion being configured to support the frame and extending parallel to a longitudinal direction of the frame; and a second seating portion that is disposed below the first seating portion in the securing space and protrudes from the inner surface of the guide to the securing space, the second seating portion being configured to support a lower end of the frame and extending parallel to the longitudinal direction of the frame.

10. The dishwasher of claim 9, wherein the frame comprises a supporting rail that protrudes from a side of the frame and extends parallel to the longitudinal direction of the frame, the supporting rail having a lower surface that is supported on an upper surface of the first seating portion.

11. The dishwasher of claim 5, wherein the button comprises:

a manipulation protrusion that protrudes upward from a center area of the button;

a first fitted portion that is coupled to the frame and extends in a longitudinal direction of the frame; and a second fitted portion that is coupled to the frame and extends in a direction crossing the longitudinal direction of the frame.

12. The dishwasher of claim 11, wherein the first fitted portion comprises:

a first projection that protrudes downward from the button relative to the manipulation protrusion; and a first frame fitted portion that is bent from the first projection in the longitudinal direction of the frame and configured to be fitted to the frame, and wherein the second fitted portion comprises:

a second projection that is spaced apart from the first projection and protrudes downward from the button relative to the manipulation protrusion, and a second frame fitted portion that is bent from the second projection in the direction crossing the longitudinal direction of the frame and configured to be fitted to the frame.

13. The dishwasher of claim 12, wherein the frame defines:

a first groove that is recessed from an upper area of the frame and receives the first projection and the second projection;

a second groove that is connected to the first groove and extends in the longitudinal direction of the frame, the second groove being configured to receive the first frame fitted portion; and a third groove that is connected to the first groove and extends in the direction crossing the longitudinal direction of the frame, the third groove being configured to receive the second frame fitted portion.

14. The dishwasher of claim 1, wherein the storage part further comprises a partition bar that partitions the tray into a first region and a second region different from the first region, wherein the storage part is disposed at the first region or the second region.

15. The dishwasher of claim 14, wherein the storage part further comprises a link configured to support the tray and to enable horizontal movement and vertical movement of the tray, the link having a first end rotatably coupled to the guide and a second end rotatably coupled to the partition bar.

16. The dishwasher of claim 15, wherein the link comprises:

a pair of first links rotatably coupled to the guide and the partition bar, respectively; and a pair of second links that are bent from the pair of first links, respectively; and a third link that connects between ends of the pair of second links and extends across the tray, the third link being configured to couple to and support the tray.

17. The dishwasher of claim 16, wherein the tray defines a securing hole at a lower area thereof, the securing hole configured to receive the third link; and wherein the tray comprises a rotation limiting portion configured to limit a rotation range of at least one of the pair of second links based on a lower surface of the rotation limiting portion contacting the at least one of the pair of second links.

18. The dishwasher of claim 17, wherein the rotation limiting portion protrudes from an edge of the tray and is configured to contact the third link, and wherein a lower surface of the tray is inclined with respect to a horizontal direction of the tray.

19. The dishwasher of claim 1, wherein the slot and the rail are disposed adjacent to each other and extend parallel to each other, and wherein the hook is configured to be inserted into the slot and to extend across a portion between the slot and the rail.

20. A dishwasher comprising a storage part, wherein the storage part is configured to accommodate a washing target, the storage part comprising:

a guide disposed at an edge area of the storage part;

a frame coupled to the guide; and a tray coupled to the frame, wherein the tray comprises a locking portion that protrudes from an edge area of the tray and is coupled to the frame, the locking portion being configured to elevate the tray with respect to the frame, wherein the frame defines a slot that receives the locking portion, wherein the frame comprises a rail that defines at least a portion of an outer shape of the slot and has a surface spaced apart from the slot, the rail being configured to guide movement of the locking portion, and wherein the locking portion comprises a hook coupled to the slot and configured to restrict the locking portion from being separated from the slot, the hook being hooked to the rail and configured to move along the slot.

* * * * *